United States Patent [19]

Bergkamp et al.

[11] 4,105,270

[45] Aug. 8, 1978

[54] RECIPE CARD STORAGE DEVICE AND DISPLAY MEANS

[76] Inventors: Helen G. Bergkamp; Robert L. Bergkamp, both of Rte. 2, Cheney, Kans. 67025

[21] Appl. No.: 782,064

[22] Filed: Mar. 28, 1977

Related U.S. Application Data

[63] Continuation-in-part of Ser. No. 648,935, Jan. 4, 1976, abandoned.

[51] Int. Cl.[2] ..... A47B 63/00

[52] U.S. Cl. ..... 312/330 R; 312/320; 312/246; 312/193; 211/50

[58] Field of Search ..... 312/330 R, 330 A, 320, 312/234–234.5, 246, 138, 193; 211/50, 46

[56] References Cited

U.S. PATENT DOCUMENTS

| | | | |
|---|---|---|---|
| 132,165 | 10/1872 | Maples | 312/246 |
| 260,951 | 7/1882 | Cutler | 312/320 X |
| 1,496,099 | 6/1924 | O'Connor | 312/246 |
| 2,150,518 | 3/1939 | Power | 312/330 |
| 2,335,391 | 11/1943 | Cushing | 312/234.3 |
| 2,446,391 | 8/1948 | Reeves | 312/193 |
| 2,592,467 | 4/1952 | Reeves | 312/193 |
| 2,609,024 | 9/1952 | Russ | 312/330 |
| 3,604,775 | 9/1971 | Anderson | 312/330 |
| 3,606,112 | 9/1971 | Cheshier | 312/246 |
| 3,918,781 | 11/1975 | Paris | 312/330 R |

FOREIGN PATENT DOCUMENTS

| | | | |
|---|---|---|---|
| 20,449 of | 1908 | United Kingdom | 312/234.4 |

*Primary Examiner*—Paul R. Gilliam
*Assistant Examiner*—Victor N. Sakran
*Attorney, Agent, or Firm*—John H. Widdowson; Edwin H. Crabtree

[57] ABSTRACT

A recipe card storage device having a drawer and drawer housing. The drawer is used for storing recipe cards. The drawer housing is mounted to a kitchen cabinet or table. The drawer has a display means which includes a drawer pull with an elongated groove for receiving the bottom edge of the recipe card. The display means provides an easy reference to the recipe card during cooking or baking in a kitchen.

3 Claims, 8 Drawing Figures

RECIPE CARD STORAGE DEVICE AND DISPLAY MEANS

CROSS REFERENCE TO RELATED APPLICATIONS

This application for patent is a continuation in part application of our application entitled RECIPE CARD STORAGE DEVICE AND DISPLAY MEANS filed Jan. 4, 1976 and having Ser. No. 648,935, now abandoned.

BACKGROUND OF THE INVENTION

This invention relates generally to cabinet and table drawers and more particularly, but not by way of limitation, to a recipe card storage drawer.

Heretofore cabinets, tables and desks include drawers with drawer pulls used to hold tickets, labels and recipe cards. One type drawer uses a clip mounted to the bottom of the drawer. The recipe is attached to the clip and viewed when the drawer is pulled out from the cabinet.

There are also drawers that have clips attached to the drawer pull for clipping tickets, labels, or recipes thereon.

None of the prior art drawers and drawer pulls are similar to the novel structure of the subject invention as herein described.

SUMMARY OF THE INVENTION

The recipe card storage device and means for displaying a recipe card is easily adaptable for mounting to a kitchen cabinet or table.

The invention provides storage for recipe cards that can be quickly removed, displayed in the front of the drawer for easy viewing and then returned to the drawer for later use.

The recipe card storage drawer includes a sliding drawer with a drawer front, and a drawer housing for receiving the sliding drawer. The drawer housing is mounted to a table or cabinet. A drawer pull is attached to the drawer front. The drawer pull includes an elongated groove in the top of the pull. The groove is parallel to the drawer front. The bottom edge of the recipe card is inserted in the groove and the top of the card is tilted against the drawer front for easy viewing.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
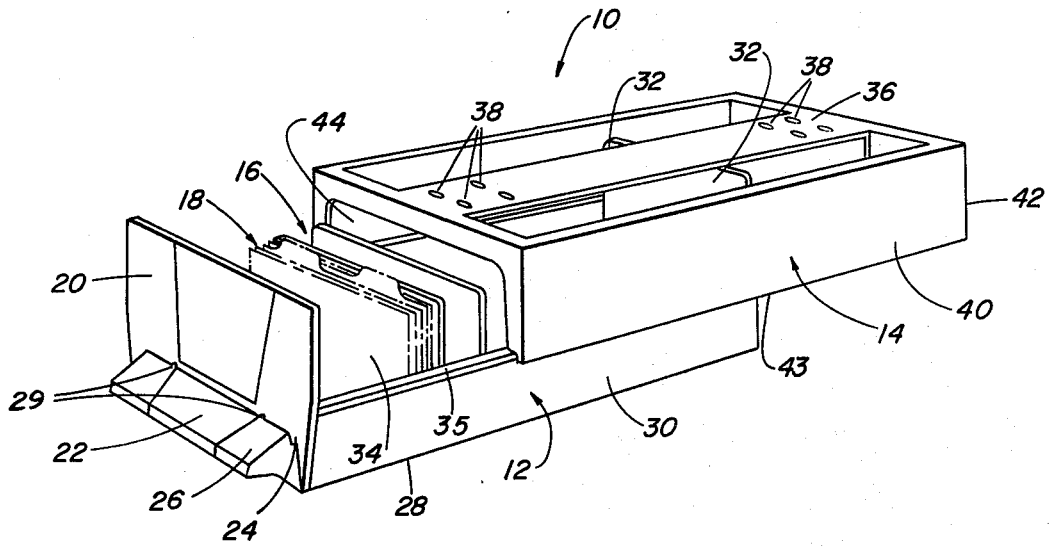
FIG. 1 is a perspective view of a recipe card storage device.

In FIG. 1, the recipe card storage device and display means is designated by general reference numeral 10. The device 10 includes a drawer 12, slidably mounted in a drawer housing 14. The drawer housing 14 may be attached to the bottom of a kitchen cabinet or any other structure for providing access to the device 10 and viewing recipe cards thereon. The drawer 12 includes a recipe card holder 16 for storing recipe cards 18 therein.

The sliding drawer 12 includes a vertical drawer front 20, having a horizontal drawer pull 22 attached to the front of the drawer front 20. The drawer pull 22 is used for opening and closing the drawer 12 in the drawer housing 14. The drawer pull 22 includes a horizontal elongated groove 24 formed in a top 26 of the drawer pull 22. The groove 24 is used for receiving the bottom edge of the recipe card 18 and displaying the recipe card thereon. The pull 22 further includes a pair of protuberances 29 which extend outwardly in the groove 24 between the drawer pull 22 and the drawer front 20. The protuberances 29 aid in securely compressing the bottom edge of the recipe card 18 between the drawer pull 22 and the drawer front 20 so that the card 18 is held in place for displaying the recipe card when using the recipe in cooking or baking.

The drawer 12 further includes a horizontal bottom 28, vertical sides 30, a vertical back 32, and an open top 34 for receiving the card holder 16 and cards 18.

The sides 30 of the drawer 12 further include outwardly extending horizontal slides 35 which are used for guiding the drawer 12 in the drawer housing 14.

The drawer housing 14 includes a horizontal top 36 having a plurality of apertures 38 therein, which are used for receiving screws for attaching the device 10 to the bottom of a cabinet or the like. Attached to the top 36 are vertical sides 40, a vertical back 42, an open bottom 43, and an open front 44. As seen in FIG. 1, the housing 14 has an inverted "U" shape.

Figure 2:
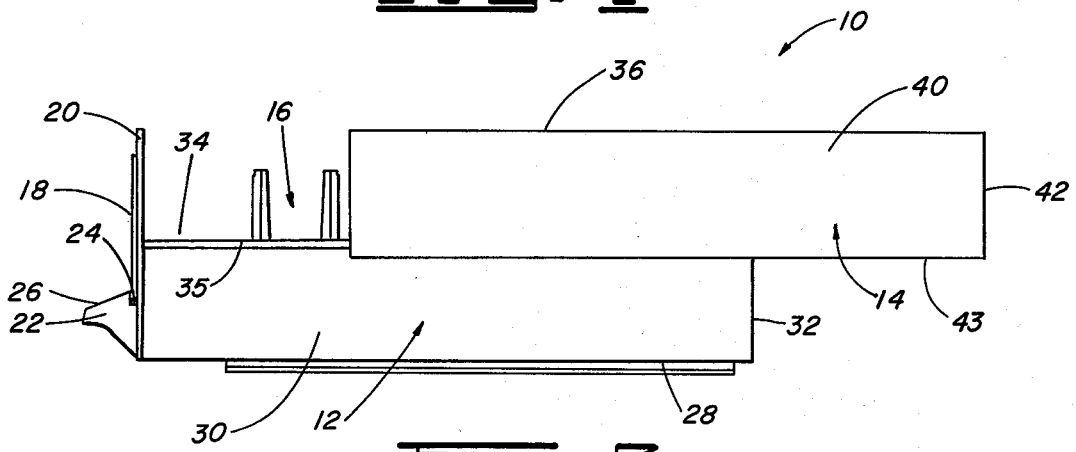
FIG. 2 is a side view of the device.

In FIG. 2, a side view of the device 10 is illustrated. In this view, the drawer 12 can be seen partially opened from drawer housing 14. Extending upwardly from the inside of the drawer 12 is the recipe card holder 16. Also shown disposed in front of the drawer 12 is a recipe card 18 displayed on the front 20 of the drawer 12 and secured between the drawer pull 22 and the front 20 in groove 24.

Figure 2A:
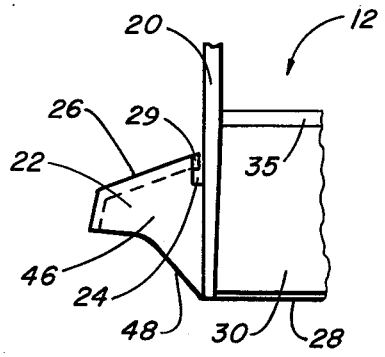
FIG. 2*a* is a side sectictional view of a drawer pull attached to a drawer front.

In FIG. 2*a*, an enlarged side sectional view of the drawer pull 22 is illustrated. The drawer pull 22 further includes sides 46 and a hollowed out bottom 48. The hollowed out bottom 48 of the pull 22 allows the pull 22 to be gripped more easily by the fingers of the hands in opening and closing the drawer 12 in the housing 14.

Figure 3:
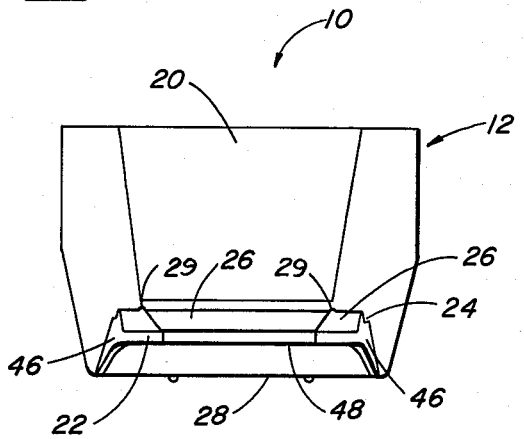
FIG. 3 is a front view of the device.

In FIG. 3, a front view of the front 20 of the drawer 12 is illustrated. In this view, the top 26, the open bottom 48, and the sides 46 of the pull can be seen. Also shown are the outwardly extending protuberances 29, shown in the groove 24.

Figure 4:
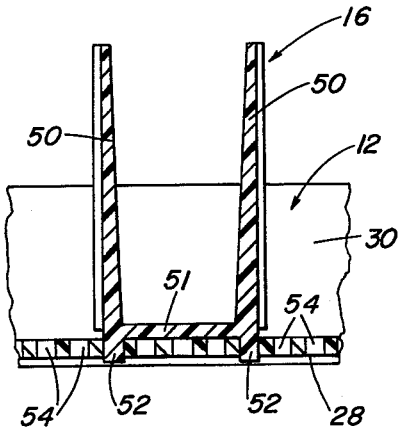
FIG. 4 is a side sectional view of a recipe card holder.

In FIG. 4, a side sectional view of the recipe card holder 16 is illustrated. The card holder 16 includes a pair of vertical parallel sides 50 attached to a horizontal bottom 51 forming a "U" shape. The holder 16 further includes a pair of downwardly extending protuberances 52 which are received in a plurality of parallel slots 54 in the bottonm 28 of the drawer 12. The protuberances 52 are received in the slots 54 in a snap fit so that the card holder 16 can be removed and placed in various positions along the length of the drawer 12.

Figure 5:
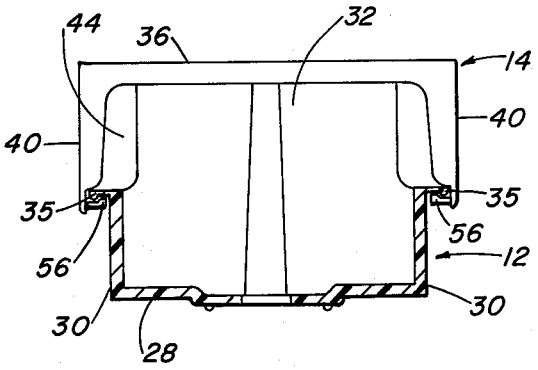
FIG. 5 is a front sectional view of a drawer slidably mounted in a drawer housing.

In FIG. 5, a front sectional view of the drawer 12 is illustrated slidably mounted in the drawer housing 14. The back 32 of the drawer 12 can be seen disposed inside the housing 14.

In this view, the horizontal outwardly extending slides 35 attached to the sides 30 of the drawer 12, are shown riding on top of inwardly extending horizontal guides 56 attached to the bottom of the sides 40 of the drawer housing 14. As the drawer 12 is opened and closed in the housing 14, the slides 35 ride along the length of the guides 56 and on the top thereof.

Figure 6:
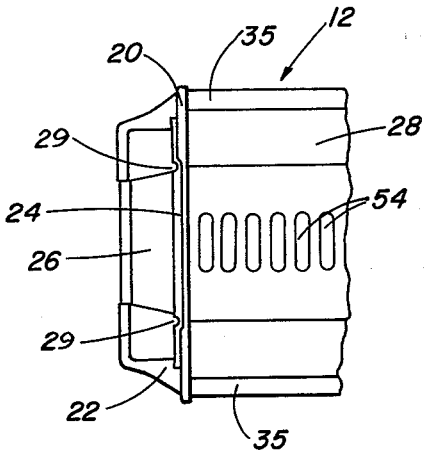
FIG. 6 is a top view of a portion of the front of the drawer.

In FIG. 6, a top view of a portion of the front of the drawer 12 is illustrated. In this view, the parallel slots 54 in the bottom 28 of the drawer 12 are shown. Also seen in this view is a top view of the groove 24 in the pull 22 with the protuberances 29 extending outwardly in the groove 24 for engaging the recipe card 18 when it is attached between the pull 22 and the front 20 of the drawer 12.

Figure 7:
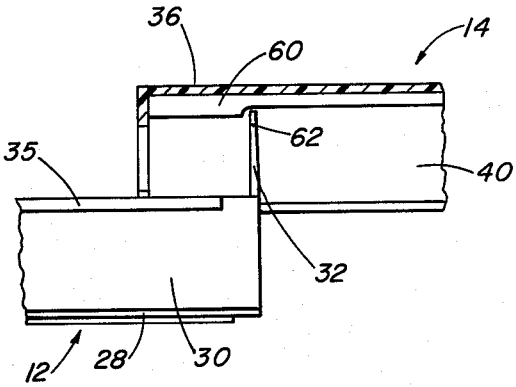
FIG. 7 is a side sectional view of the front of the drawer housing and the rear of the drawer.

In FIG. 7, a side sectional view of the front of the drawer housing 14 is shown to illustrate how the vertical back 32 of the drawer 12 engages a downwardly extending stop 60 which is attached to the top 36 of the drawer housing 14. When the drawer 12 is opened and to prevent the drawer 12 from accidentally being pulled free from the housing 14, a top portion 62 of the back 32 of the drawer 12 engages the downwardly extending stop 60 of the housing 14. This engagement prevents the drawer 12 from being opened further in the housing 14.

Changes may be made in the construction or arrangement of the parts or elements of the embodiments as disclosed herein without departing fromtthe spirit or scope of the invention as defined in the following claims.

We claim:

1. A recipe card storage device for displaying recipe cards and storing them therein, the device comprising:

a sliding drawer including:

a drawer front;

a drawer pull attached to the front of the drawer front, the drawer pull used for opening and closing said drawer, a horizontal elongated groove formed in the top of the drawer pull for recieving the bottom edge of the recipe card and displaying the recipe card therein, the drawer pull including outwardly extending protuberances in the groove for engaging the sides of the bottom edge of the recipe card and compressing the card between the pull and the drawer front;

an open drawer top for receiving recipe cards therein;

a drawer bottom attached to the drawer front and having a plurality of parallel slots disposed in a spaced relationship along the length of the drawer bottom;

drawer sides attached to the drawer bottom and the drawer top, the top of the drawer sides including outwardly extending horizontal drawer slides;

a drawer back attached to the drawer sides and the drawer bottom;

an inverted "U" shaped drawer housing including:

a horizontal housing top for attaching to the bottom of a cabinet or the like, the top including a downwardly extending stop, the stop engaging the back of said drawer when said drawer is pulled outwardly from said drawer housing;

vertical housing sides attached to the housing top, the bottom of the housing sides having inwardly extending horizontal drawer guides for receiving the horizontal drawer slides thereon and guiding said drawer in said housing;

a vertical housing back attached to the housing top and sides;

an open housing bottom;

an open housing front for receiving the drawer front of said drawer adjacent thereto; and a "U" shaped card holder having vertical sides attached to a bottom, the bottom of said card holder having downwardly extending protuberances, said protuberances received in the parallel slots in the bottom of said drawer in a snap-fit for holding said card holder in said drawer.

2. The device as described in claim 1 further including a plurality of apertures in the top of said drawer housing for receiving screws therethrough and attaching said drawer housing to the bottom of a cabinet or the like.

3. The device as described in claim 1, wherein the drawer pull of said drawer includes an open bottom portion for ease in gripping the drawer pull with the fingers of the hand when opening said drawer in said drawer housing.

* * * * *